US007520058B1

(12) United States Patent
Allen et al.

(10) Patent No.: US 7,520,058 B1
(45) Date of Patent: Apr. 21, 2009

(54) METHOD FOR ENLARGING A RING

(75) Inventors: David M. Allen, Lafayette, LA (US); Ricky L. Williams, Lafayette, LA (US); Brett M. Northcutt, Carencro, LA (US); Patrick N. Dubois, Lafayette, LA (US); David J. DeMoia, Breaux Bridge, LA (US); Alfred J. Thibodeaux, Carencro, LA (US); Gary Keith Fontenot, Youngsville, LA (US)

(73) Assignee: Stuller, Inc., Lafayette, LA ( * ) Notice: Subject to any disclaimer, the term of this patent is extended or adjusted under 35 U.S.C. 154(b) by 557 days.

(21) Appl. No.: 11/394,023

(22) Filed: Mar. 30, 2006

(51) Int. Cl.
*A44C 27/00* (2006.01)

(52) U.S. Cl. ..... 29/896.4; 29/8; 29/896.412; 63/15

(58) Field of Classification Search ..... 29/8, 29/896.4, 896.412, 401.1; 63/15, 15.2, 15.5; 219/606; 228/213
See application file for complete search history.

(56) References Cited

U.S. PATENT DOCUMENTS

| | | | |
|---|---|---|---|
| 324,553 | A | 8/1885 | Hanf |
| 1,550,191 | A | 8/1925 | Werner |
| 1,740,191 | A | 12/1929 | Martinkevich |
| 1,996,183 | A | 4/1935 | Walters |
| 2,121,201 | A | 6/1938 | Joyce |
| 2,747,259 | A | 5/1956 | Brioux |
| 3,055,329 | A | 9/1962 | Door |
| 3,127,757 | A | 4/1964 | Weiss |
| 4,538,430 | A | 9/1985 | Parks |
| 5,253,490 | A | 10/1993 | Doganay |
| 5,353,513 | A | 10/1994 | Round |
| 5,456,095 | A | 10/1995 | Tawil et al. |
| 5,590,450 | A | 1/1997 | March |

(Continued)

FOREIGN PATENT DOCUMENTS

| | | | |
|---|---|---|---|
| JP | 56056742 | B1 | 5/1981 |

(Continued)

OTHER PUBLICATIONS

Oct. 2, 2004 correspondence from Leamon Cotton of The Jeweler's Bench to Stuller, Inc.

*Primary Examiner*—David P Bryant
*Assistant Examiner*—Ryan J Walters
(74) *Attorney, Agent, or Firm*—Roy, Kiesel, Keegan & DeNicola

(57) ABSTRACT

A method of enlarging a ring. A ring to be enlarged is severed, preferably with an end mill, and then expanded. The end mill will preferably cut a circular section from the ring, so that the ends of the now severed ring are concave. A plurality of preformed bars are also provided. The bars will have curved ends that match the curvature of the ring ends. The curvature of the bars and the ring will also match. The width of the various bars, between the ends, will be selected to correspond to desired increases in the ring circumference. A cross-sectional slice will be cut from a bar of the appropriate width and inserted into the severed ring. The ring and the cross-section will then be joined together, preferably with an induction welder, which can be used to quickly heat only a limited portion of the ring and insert.

17 Claims, 11 Drawing Sheets

U.S. PATENT DOCUMENTS

| | | | | |
|---|---|---|---|---|
| 5,628,208 | A | 5/1997 | Rood | |
| 5,636,531 | A | 6/1997 | Miller | |
| 6,003,334 | A | 12/1999 | Miller | |
| 6,192,708 | B1 | 2/2001 | Mitchell | |
| 6,672,105 | B1 | 1/2004 | Sills | |
| 6,748,764 | B1 | 6/2004 | Roemer | |
| 7,412,757 | B2 * | 8/2008 | Corkran et al. | 29/8 |
| 2003/0159463 | A1 | 8/2003 | Rosenberg | |
| 2004/0025984 | A1 | 2/2004 | Holemans et al. | |
| 2004/0103688 | A1 | 6/2004 | Flaviano | |
| 2004/0200235 | A1 | 10/2004 | Kretchmer | |
| 2006/0032893 | A1 | 2/2006 | Corkran et al. | |

FOREIGN PATENT DOCUMENTS

| | | | |
|---|---|---|---|
| JP | 59201726 | B1 | 11/1984 |

* cited by examiner 109
103
106
111
110
112
113
102
104
105

104
102
105
114

Fig 7A
| MILL SIZE | | | | | | | |
|---|---|---|---|---|---|---|---|
| 2.00 mm | 3.25 mm | 4.50 mm | 5.75 mm | 7.00 mm | 8.25 mm | 9.50 mm | 10.75 mm |
| 1.75 mm | 3.00 mm | 4.25 mm | 5.00 mm | 6.75 mm | 8.00 mm | 9.25 mm | 10.50 mm (8) |
| 1.5 mm | 2.75 mm | 4.00 mm | 5.25 mm | 6.50 mm | 7.75 mm | 9.00 mm | 10.25 mm |
| | 0.5 | 1.0 | 1.5 | 2.0 | 2.5 | 3.0 | 3.5 |
| | INCREASE IN RING SIZE | | | | | | |
Fig 7B
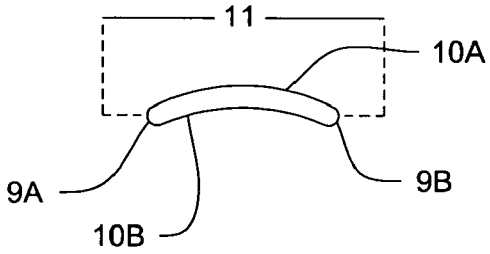
Fig 7C
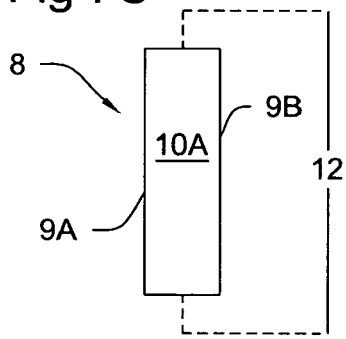
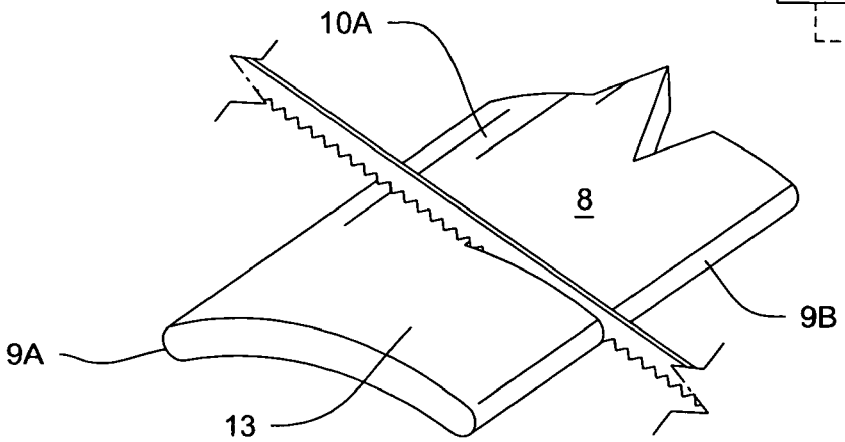
Fig 8

METHOD FOR ENLARGING A RING

BACKGROUND OF THE INVENTION

1. Field of the Invention

The invention relates to methods of altering jewelry in general and to methods of enlarging rings in particular.

2. Prior Art

Rings are commonly expanded in the jeweler's art. The owner's finger's may swell with advancing age or the ring may literally change hands, such that a larger size is required. One way that rings are expanded is by placing them on a steel mandrel and forcing the ring onto the wider part of the mandrel with a hammer, stretching the ring. This method is typically appropriate for enlarging rings up to ½ ring size, but damage to the ring is possible, even within this range.

For expansions of more than ½ ring size, prior art rings would typically be severed with a jeweler's saw. This would create two ends in the ring, both of which would be substantially flat. The now severed ring would then be placed on a mandrel and expanded to the desired dimension.

Next, a piece of flat stock would be selected and cut to match the width of the space between the ring ends. The flat stock piece would be worked to produce a curvature and shape that matched that of the ring. Additionally, the ends of the severed ring and the ends of the section of flat stock would be worked to allow them to roughly mate. For example, the ends of the ring might be filed to a point and grooves would be filed into the ends of the flat stock section, so that when the flat stock section was placed into the gap in the severed ring, the points of the ring ends could fit into the grooves in the ends of the flat stock.

Solder chips would typically have been applied to each joint between the ring ends and the insert ends, often with a resistance welder. The joint would have then been heated, usually with a torch, until the solder flowed into the gap. The enlarged ring would then be finished to match the shape, finish and luster of the original ring.

This method has several drawbacks. Most of the fitting work on the flat stock and the ring ends must be done by hand or with small power tools. In either case, it is time consuming. Additionally, matching the ends of the ring to the ends of the flat stock insert is difficult. Frequently, there are substantial gaps in the joints between the ring ends and the flat stock. This can require an excessive amount of solder to be used in fitting the insert to the ring, and can also lead to pitting in the area.

Soldering with a jeweler's torch can result in substantial heating of large portions of the ring and flat stock insert. Such high temperatures can damage various alloys used in jewelry, and it can also exacerbate the pitting problem mentioned above. Localized melting of the ring can also occur, which can damage the finish of the ring, requiring remedial work on the part of the jeweler. Where the ring is engraved or otherwise provided with surface decorations, such unintended melting can damage the ring in ways that are not easily corrected. Therefore, a method of enlarging a ring that satisfies the following objectives is desired.

OBJECTS OF THE INVENTION

It is an object of the invention to provide a method of enlarging a ring that minimizes the degree to which the ring and insert must be worked.

It is another object of the invention to provide a method of enlarging a ring in which the ring is severed to match the insert.

It is still another object of the invention to provide a method of enlarging a ring in which the inserts are pre-formed to match the space in the ring.

It is still another object of the invention to provide a method of enlarging a ring in which the amount of the ring that must be heated is minimized.

It is yet another object of the invention to provide a method of enlarging a ring in which the time that the ring must be heated can be minimized.

SUMMARY OF THE INVENTION

A method of enlarging a ring is disclosed. A ring to be enlarged is severed, preferably with an end mill, and then expanded to the desired circumference. The end mill will preferably cut the ring along a line that would be generally parallel to the wearer's finger, were the ring on the wearer's hand while it was being cut. The end mill will also preferably cut a circular section out of the ring, so that each of the ends of the now severed ring are concave. A plurality of preformed bars are also provided. The bars will have curved ends that match the curvature of the severed ring ends. The width of the various bars, between the ends, will be selected to correspond to desired increases in the ring circumference. One bar will be the appropriate width for enlarging the ring by ½ ring size, while another will be the appropriate width for enlarging ring by one full ring size and so forth. The curvature of each bar will also generally match the curvature of the ring being expanded. A cross-sectional slice will be cut from a bar of the appropriate width and inserted into the severed ring. The ring and the cross-section will then be joined together, preferably via induction welding, which can be used to quickly heat only a limited portion of the ring and insert. Any excess material will be removed from the now joined ring and insert to provide for a smooth transition between the ring ends and the insert, and the ring will be polished to restore its original finish and luster.

BRIEF DESCRIPTION OF THE FIGURES

FIG. 7A is a perspective view of a plurality of precious metal bars.

FIG. 7B is an end view of a precious metal bar.

FIG. 7C is a top plan view of a precious metal bar.

FIG. 8 is a perspective view of a cross-section being cut from a precious metal bar.

DETAILED DESCRIPTION OF THE PREFERRED EMBODIMENT

Figure 1B:
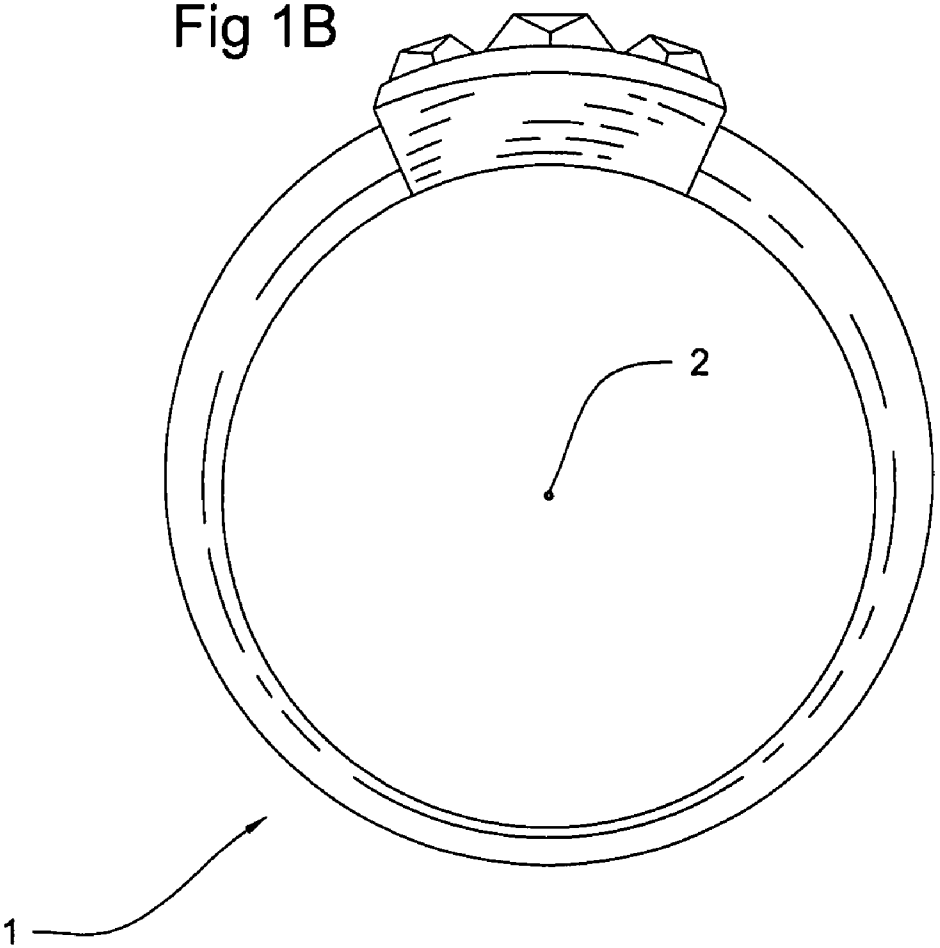
FIG. 1B is a side view of a ring.
Figure 1A:
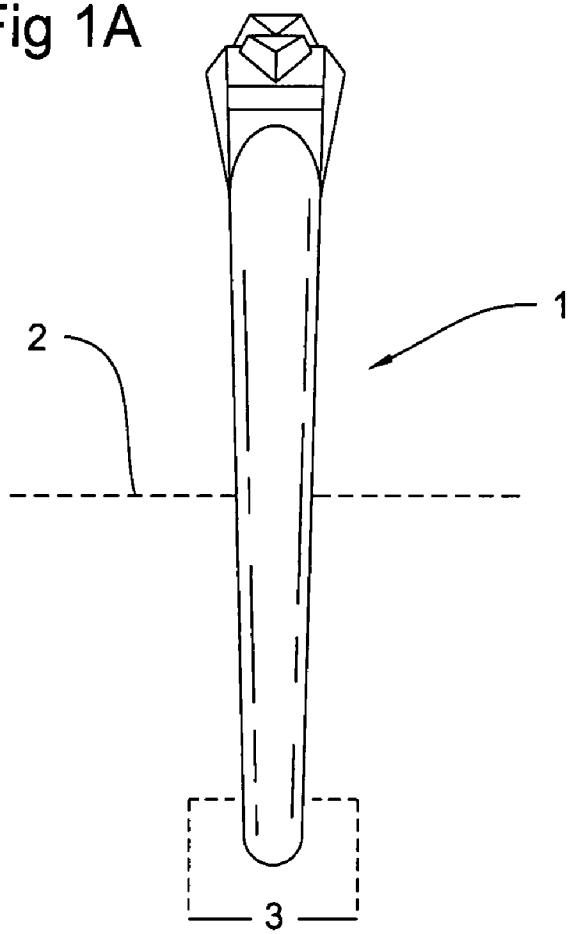
FIG. 1A is an end view of a ring.
Figures 2A, 2B:
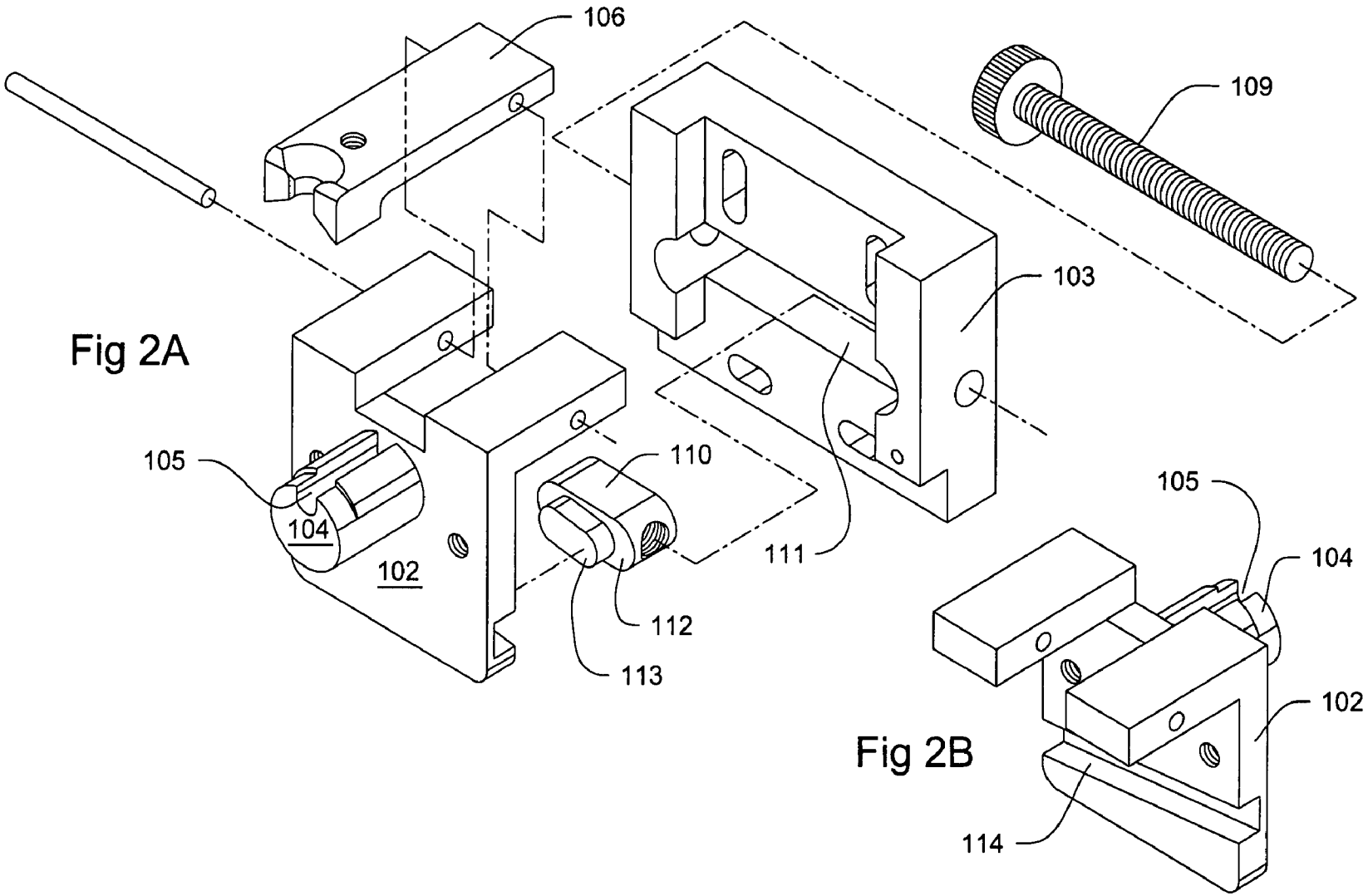
FIG. 2A is an exploded view of a preferred embodiment of a ring clamp.
FIG. 2B is a rear view of a front plate from a preferred embodiment of a ring clamp.
Figure 3A:
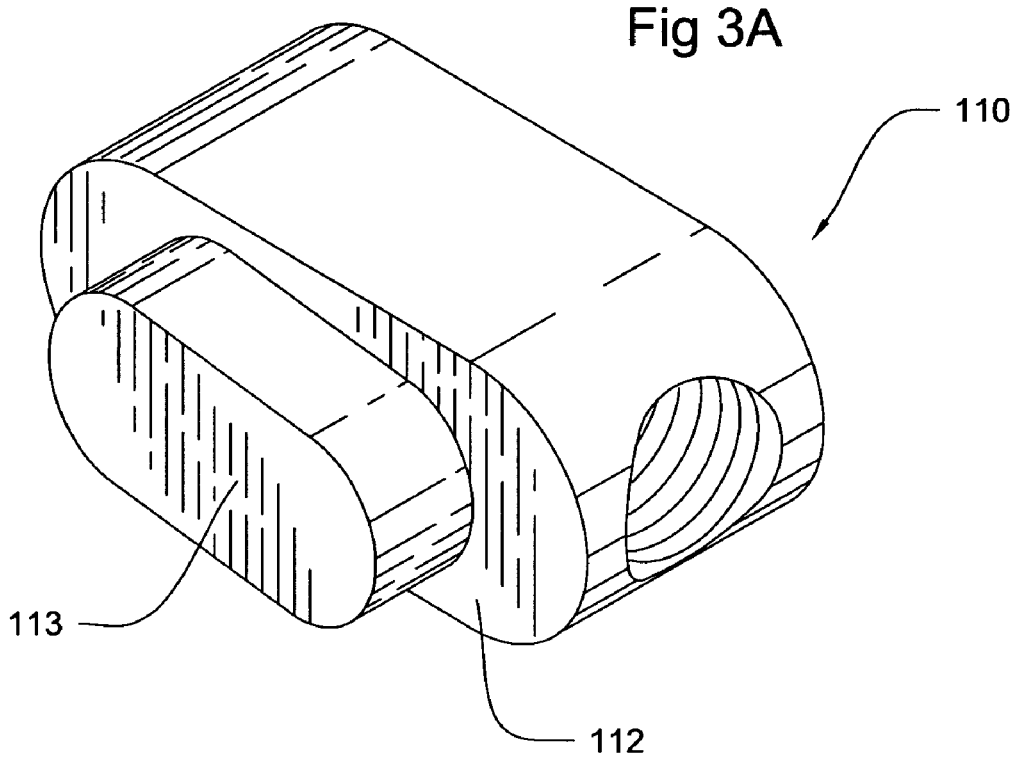
FIG. 3A is perspective view of an elevating nut.
Figure 3B:
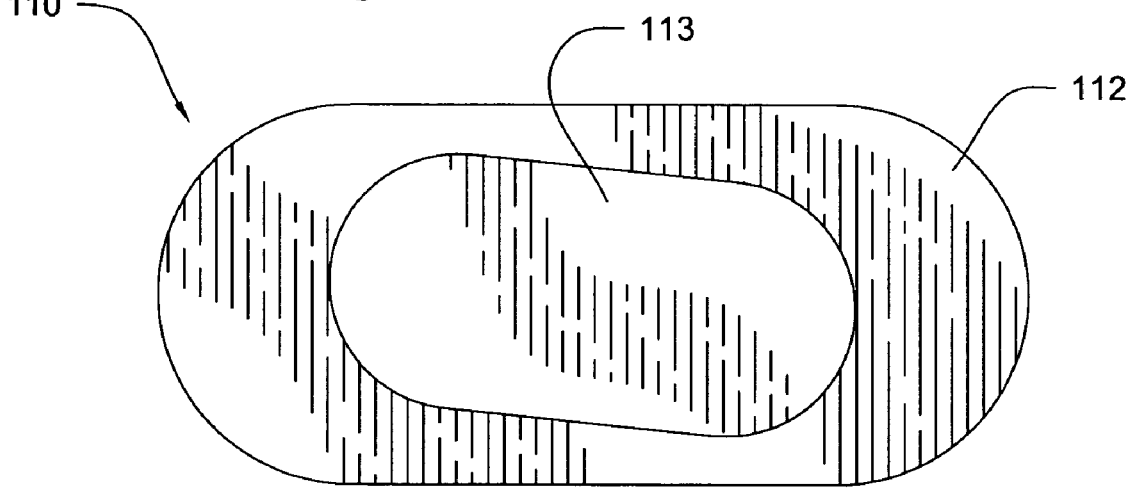
FIG. 3B is an end view of an elevating nut.
Figure 4A:
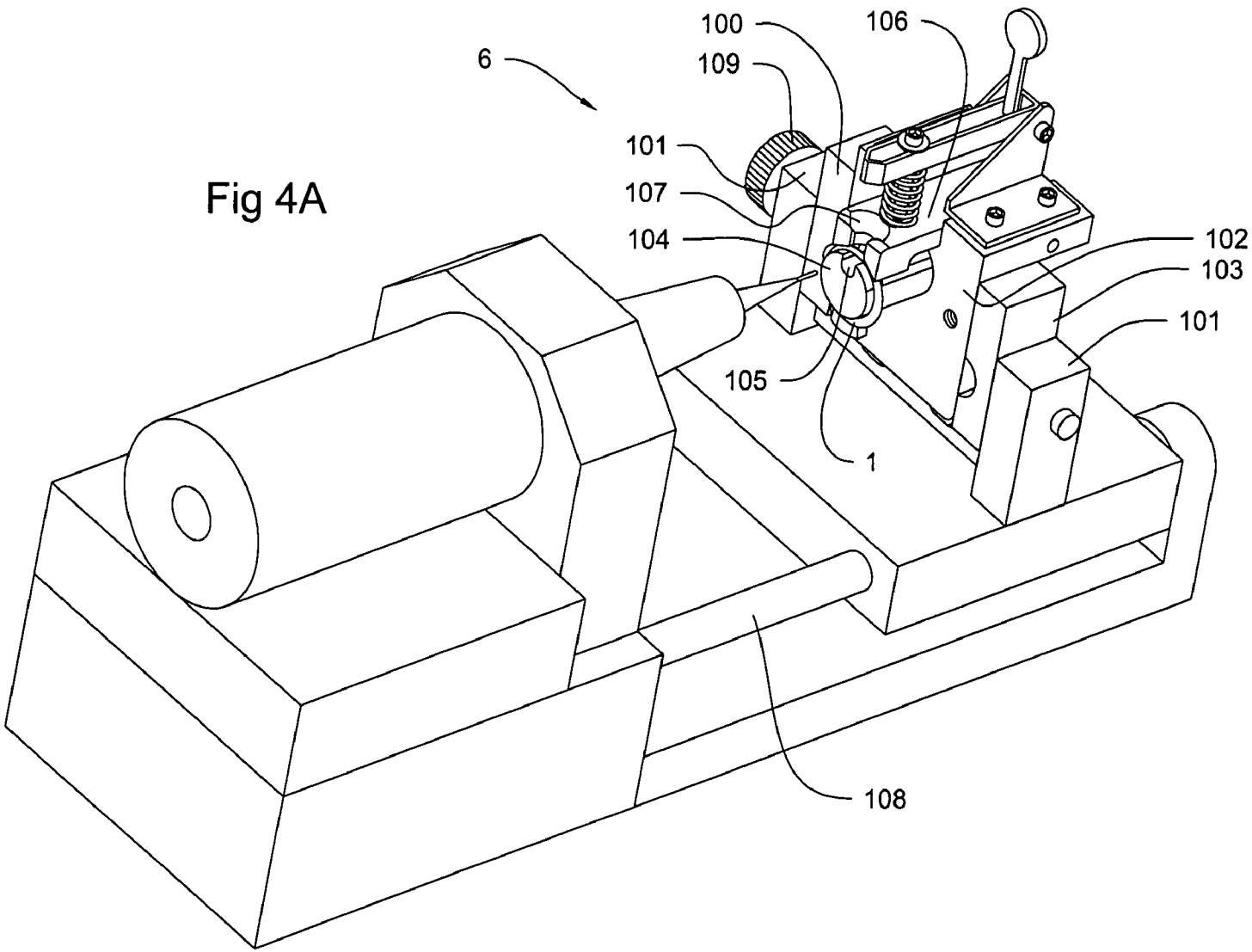
FIG. 4A is a perspective view of a milling device having a ring clamp in a frame where the ring clamp is engaging a ring to be milled.
Figure 4B:
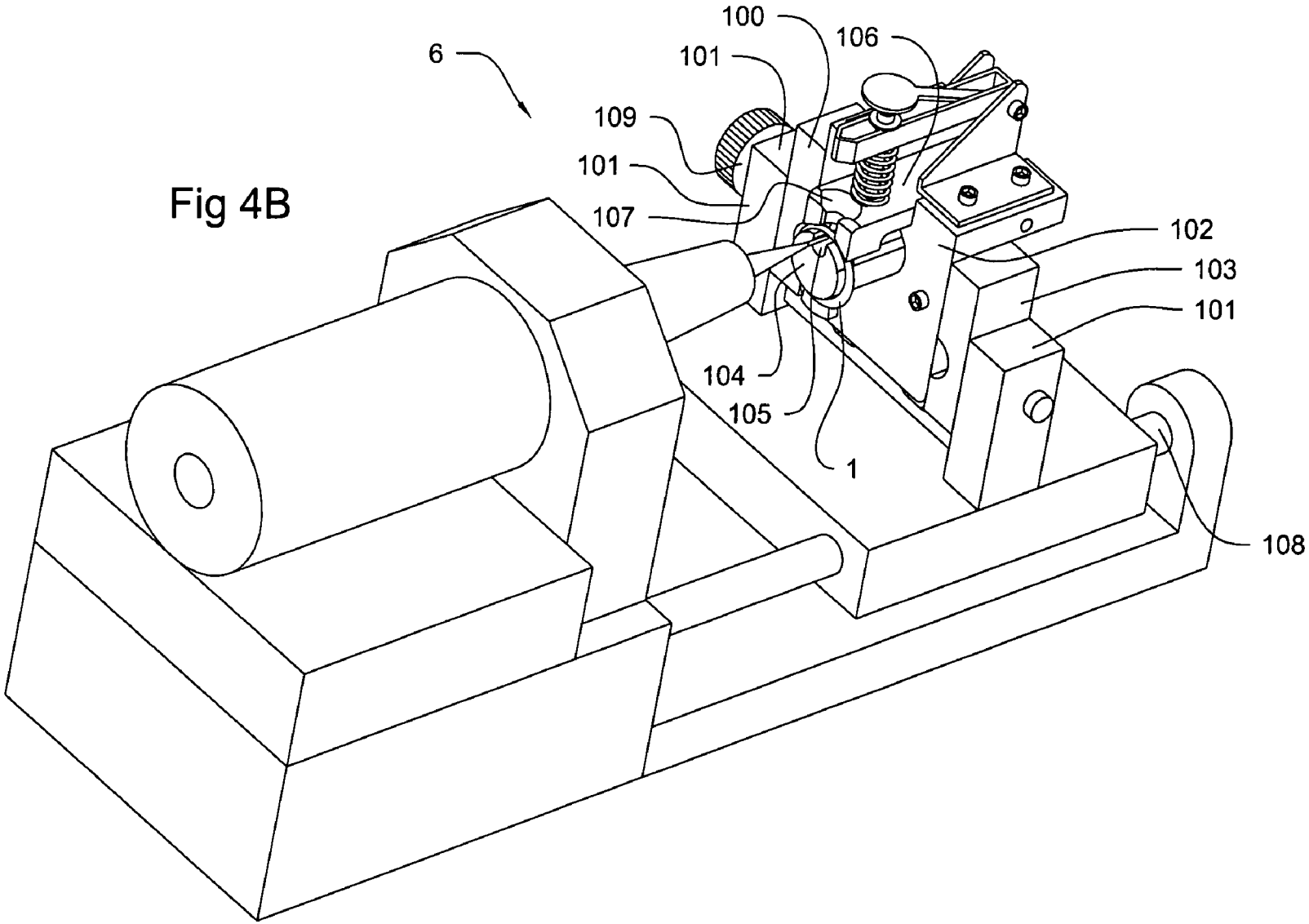
FIG. 4B is a perspective view of the milling device of FIG. 4A in which the ring is being moved into contact with the end mill.
Figure 6:
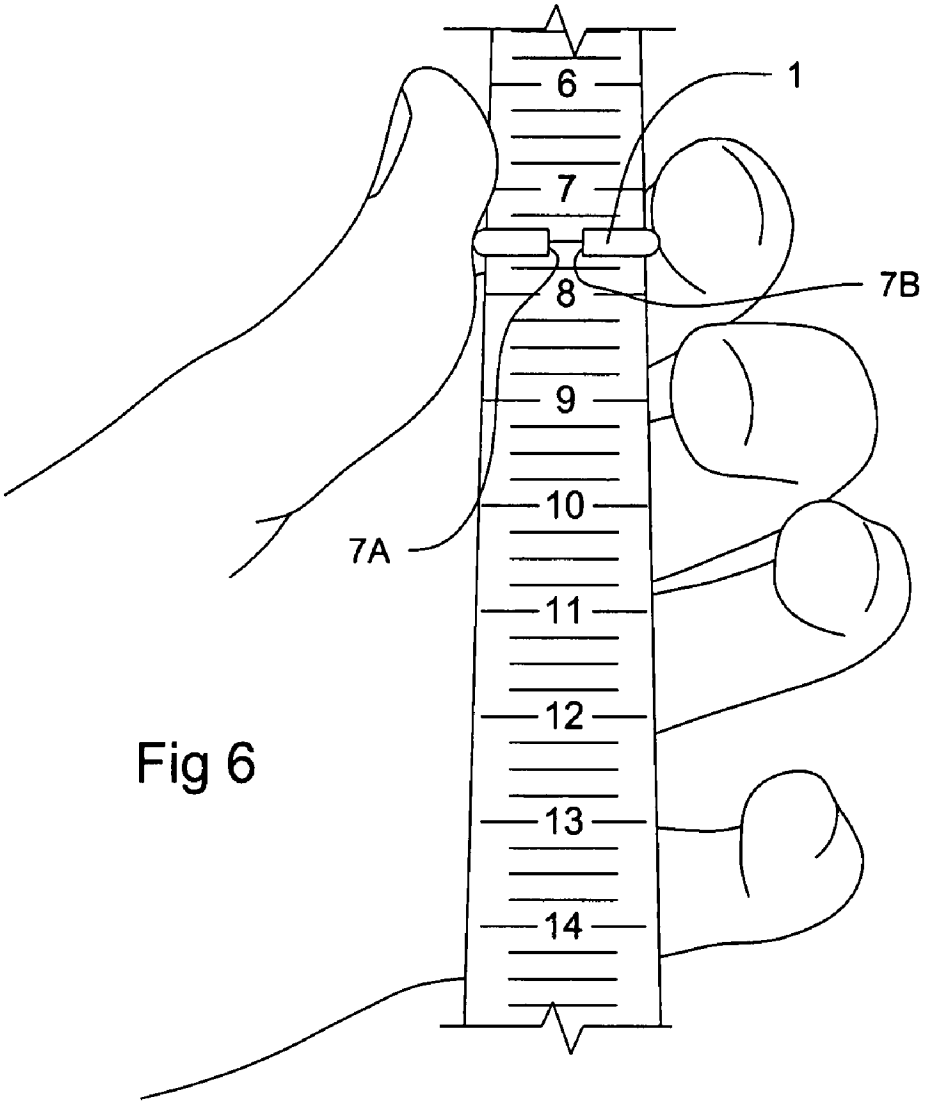
FIG. 6 is an end view illustrating a severed ring being expanded on a mandrel to a desired size.
Figure 5:
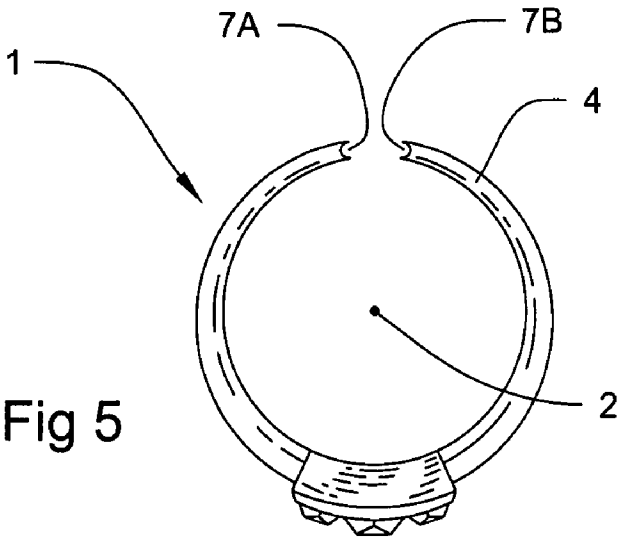
FIG. 5 is a side view of a ring that has been severed with a preferred embodiment of the milling device.
Figure 9:
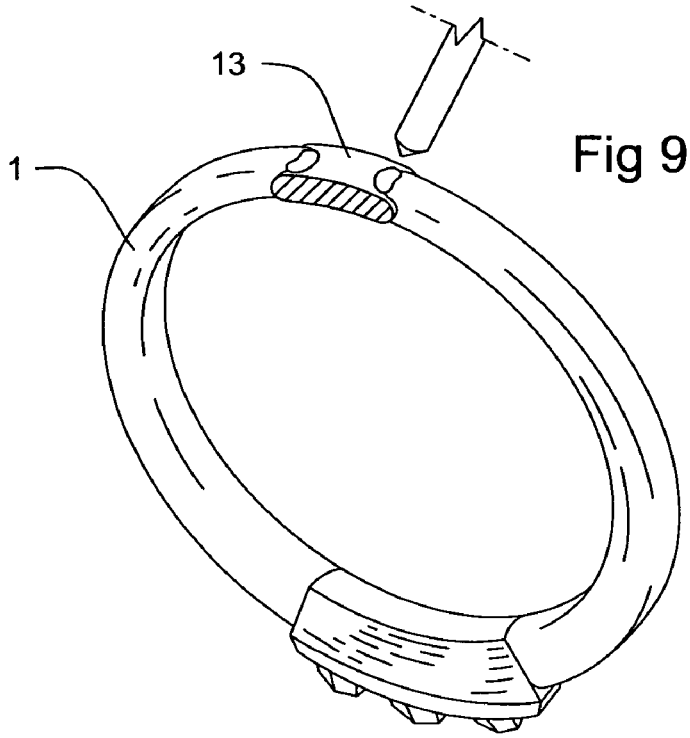
FIG. 9 is a perspective view of a cross-section being tacked to an expanded ring with solder.
Figure 10:
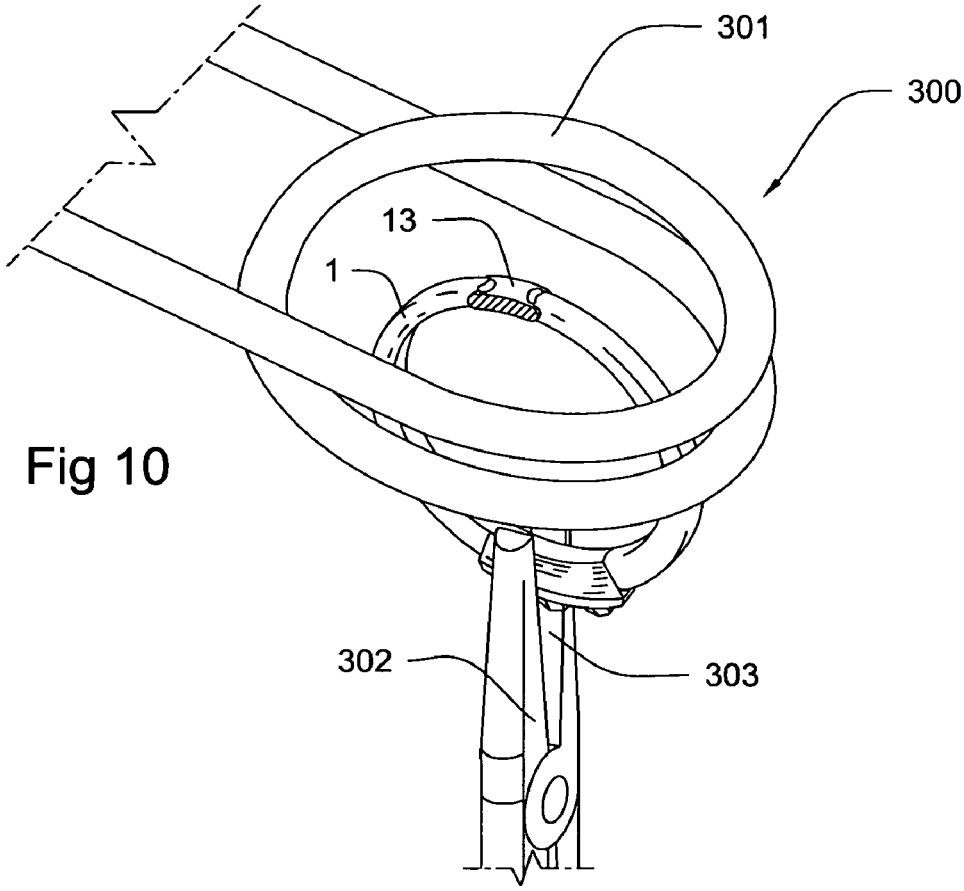
FIG. 10 is a perspective view of a ring and cross-section being inserted into an induction welding machine.
Figure 11:
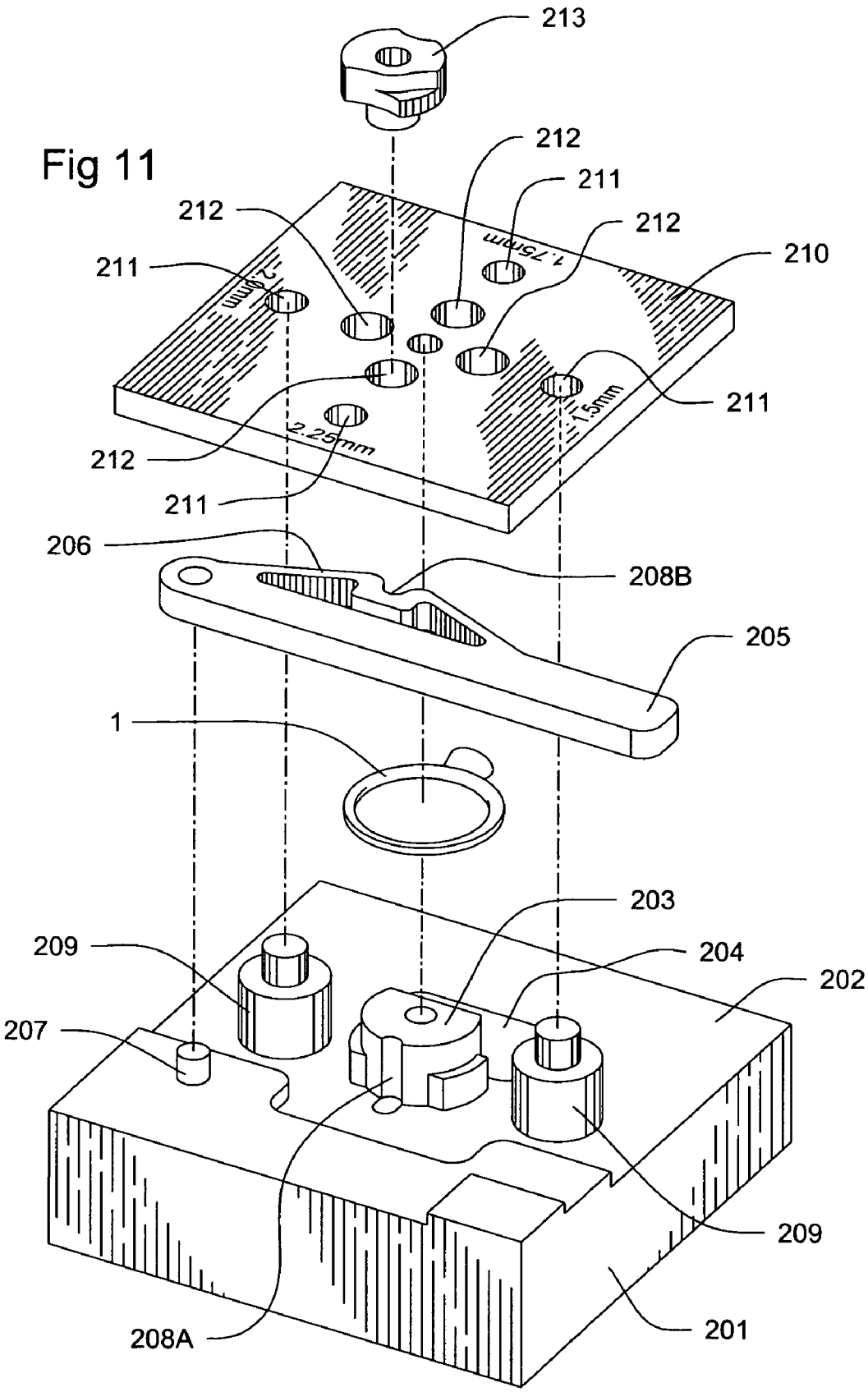
FIG. 11 is an exploded view of another preferred embodiment of a ring clamp showing a ring.
Figure 12:
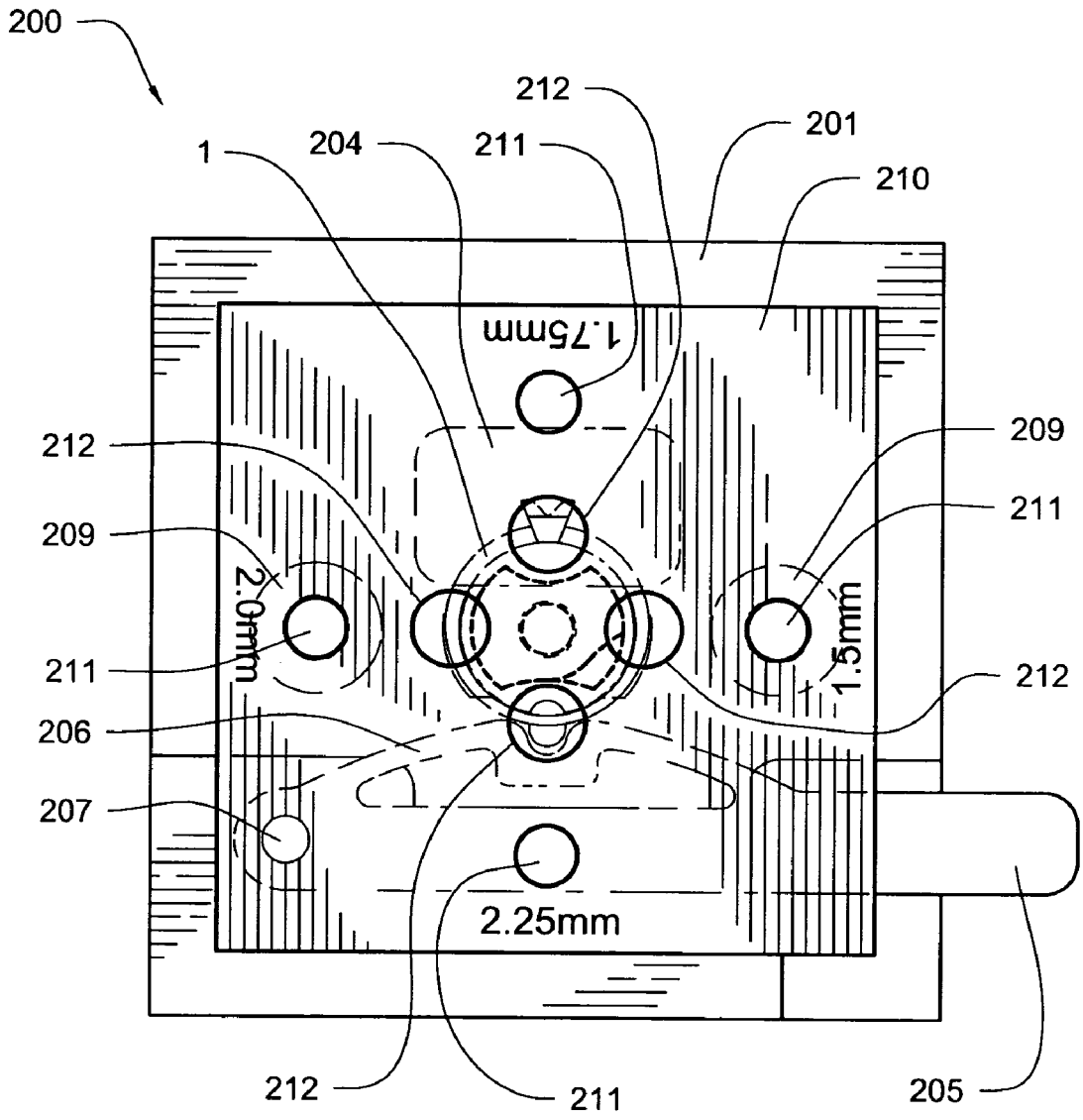
FIG. 12 is a top plan view of the ring clamp of FIG. 11 showing a ring in place.
Figure 13:
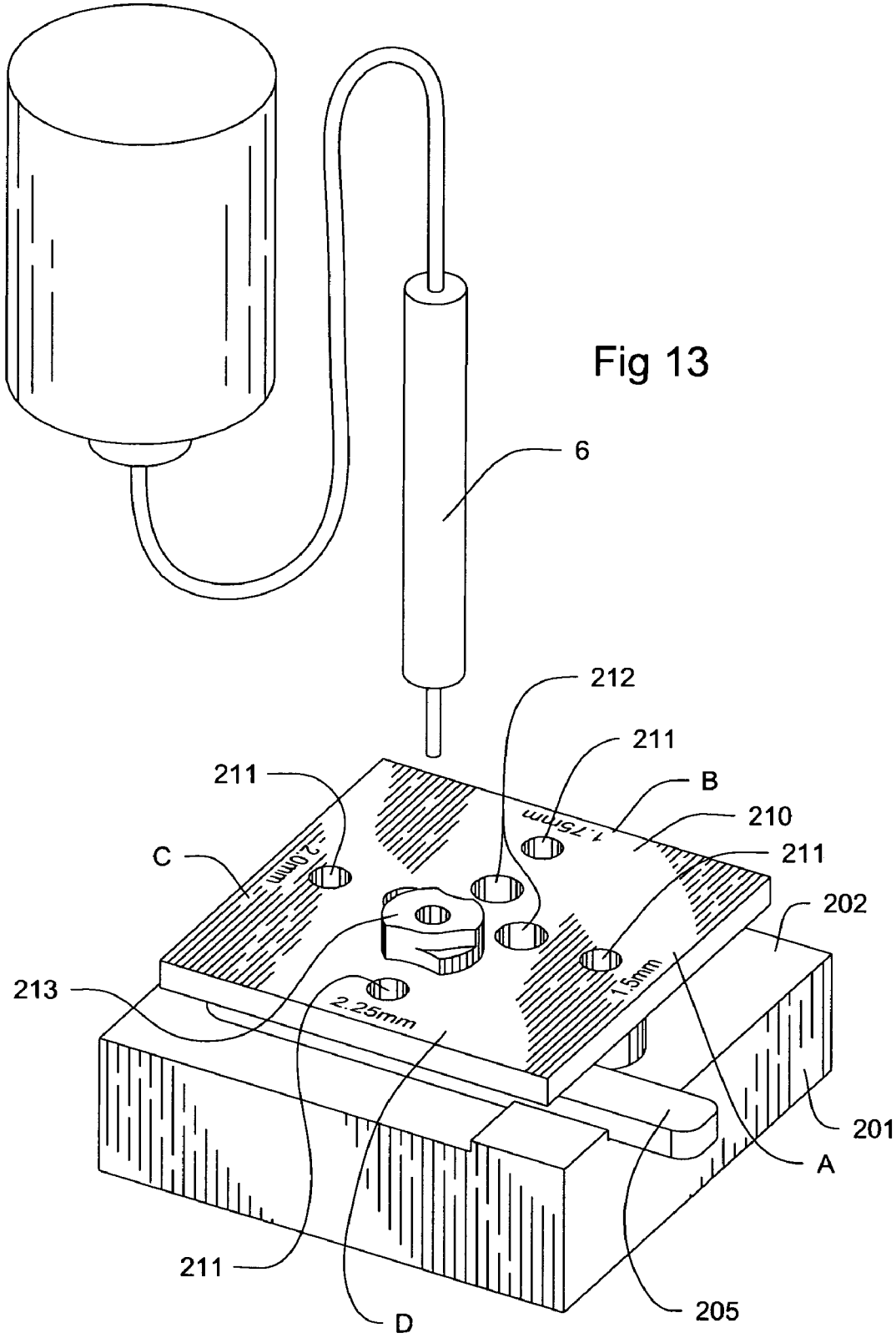
FIG. 13 is a perspective view of the ring clamp of FIG. 11 showing a milling device about to sever a ring in the clamp.

A method of increasing the size of a ring 1 is disclosed. Rings, as the term is used herein, are generally circular objects of jewelry intended to be worn on a digit, usually a finger. As a point of reference, rings have a central axis 2 that passes through their center, is generally parallel to all of the sides of the ring, and touches none of them. The width 3 of ring 1 is that dimension of the side 4 of ring 1 that is parallel to central axis 2 of ring 1. The thickness of ring 1 is that dimension perpendicular to central axis 2. Ring 1 will preferably be made of precious metals such as gold, silver, platinum, or alloys of the foregoing.

To enlarge ring 1, ring 1 will first be severed. This is preferably done with a milling device 6. The inventors developed a milling device from a pearl drill which, as the name implies, is a device commonly used in the jewelry industry for drilling holes in pearls. The inventors used a model YS 100 pearl drill available from Yotsuba Co., Ltd. of 1-19-3, Okamoto, Ise-shi, MIE-Pref, 516-0036, Japan.

In these machines, the drill is stationary and a pearl holder is mounted on a moveable slide that will allow the pearl to be moved into contact with the drill. The inventors replaced the bushing in the slide of the Yotsuba drill with a brass and nylon bushing obtained from Misumi USA, Inc. of 1105 Remington Rd., Suite B; Schaumburg, Il 60173.

The inventors also replaced the pearl bit of the Yotsuba drill with an all carbide two flute end mill. Preferably, end mills of different sizes will be provided with each milling device 6. The inventors used end mills that cut circles of 1.5 mm, 1.75 mm and 2.0 mm. The use of end mills that cut circles of different diameters is desirable because rings 1 will come in different thicknesses. End mills of other thicknesses could be provided as desired, but these diameters are expected to suffice for most ring thicknesses. The inventors had several pearl drills at their disposal, so they mounted one end mill on each converted milling device 6. However, the inventors contemplate the rotary shaft of milling device 6 being configured to receive interchangeable end mills, most likely using a releaseable chuck such as those commonly used on drills to allow the use of interchangeable bits.

The inventors also replaced the pearl clamp on the Yotsuba drill with a ring clamp they designed. This clamp had several design criteria. It needed to engage the ring securely, ideally in at least two places, to prevent undue torque being placed on the ring or the clamp. It also needed to provide relief to accommodate ring heads of various sizes. Additionally, the operator of the milling device will usually want to be able to see the ring at the point where the end mill will cut the ring, to ensure that the end mill and the ring are aligned. Accordingly, the clamp should preferably not obstruct the operator's view of the ring at this point. Finally, the clamp should preferably allow for the adjustment of the ring position so that the ring and the end mill can be aligned if they are not.

The clamp 100 the inventors designed comprises a frame 101, a front plate 102 and a rear plate 103. A substantially cylindrical ring support member 104 extends from front plate 102. The upper edge of ring support member 104 includes a groove 105. A clamp arm 106 is pivotally mounted to front plate 102. Clamp arm 106 will clamp down on cylindrical ring support member 104 such that when ring 1 rests on cylindrical ring support member 104, ring 1 will be held between clamp arm 106 and cylindrical support member 104. Clamp arm 106 is positioned so that it will engage ring 1 on both sides of groove 105, thereby providing two points of contact between clamp 100 and ring 1.

Additionally, the end of cylindrical support member 104 is spaced from front plate 102 and from the bottom of front plate 102. This will provide room below cylindrical support member 104 and between the end of cylindrical support member 104 and front plate 102 to accommodate rings of varying head sizes.

Clamp arm 106 also includes a notch 107. Notch 107 in clamp arm 106 is positioned to align with groove 105 in cylindrical ring support member 104. Thus, clamp arm 106 will not obscure the portion of ring 1 resting on top of cylindrical ring support member 104.

Frame 101 is mounted on slide 108, and front plate 102 and rear plate 103 are mounted in frame 101. Frame 101 and front and rear plates 102, 103 are positioned to horizontally align groove 105 with the cutting portion of milling device 6. Preferably, frame 101 will not allow any substantial horizontal movement of plates 102, 103, groove 105, or cylindrical ring support member 104.

Cylindrical ring support member 104 is adjustable to allow ring 1 to be aligned vertically with the cutting portion of milling device 6. In the preferred embodiment, this is done by providing an externally threaded rod 109 which passes through frame 101 and rear plate 103. An internally threaded elevating nut 110 is disposed around threaded rod 109. A first slot 111 is provided in rear plate 103. Threaded rod 109 passes through first slot 111, and elevating nut 110 is positioned to move along threaded rod 109 within first slot 111 as threaded rod 109 is rotated. Slot 111 will prevent nut 110 from rotating. If nut 110 cannot rotate, it must move along rod 109 as rod 109 rotates.

Nut 110 has a face 112 which faces front plate 102. A lifting arm 113 extends from face 112. Lifting arm 113 is preferably angled.

Front plate 102 includes a second slot 114. Second slot 114 is angled relative to first slot 111. Second slot 114 is designed and configured to receive lifting arm 113. The degree of angle of lifting arm 113 should preferably match the degree of angle of second slot 114. Thus, elevating nut 110 is disposed in both first slot 111 and second slot 114. As nut 110 moves along rod 109 and within first slot 111, the lifting arm 113 portion of nut 110 will also move along and within second slot 114. Second slot 114 and first slot 111 will necessarily diverge because of the angle of second slot 114. However, moving nut 110 through diverging slots 111, 114 will force slots 111, 114 to converge.

Frame 101 and rod 109 will not allow rear plate 103 to move. Because rear plate 103 and frame 101 are fixed, front plate 102 must rise and fall to allow slots 111, 114 to converge as nut 110 is moved through both of them. Thus, front plate 102 will rise and fall as rod 109 is rotated. Cylindrical ring support member 104 and any ring 1 resting on ring support member 104 will rise and fall with front plate 102. Thus, turning rod 109 will allow ring 1 to be vertically adjusted within clamp 100.

The inventors also contemplate a second clamp 200 particularly well suited for use with a hand tools such as a hand drill or flexible shaft tool fitted with an end mill. In the preferred embodiment, second clamp 200 comprises a base plate 201 having a face 202. Base plate 201 is preferably formed of metal or strong plastic. A generally cylindrical ring support member 203 is preferably centrally positioned on face 202 of base plate 201. Cylindrical ring support member 203 is preferably substantially perpendicular to face 202.

A ring relief aperture 204 is preferably contained in base plate 201 on one side of ring support member 203. Ring relief aperture 204 should be sized to receive most common setting sizes so that ring 1 may be positioned around ring support member 203 and lie flat on face 202.

A clamp arm 205 is also preferably attached to face 202 of base plate 201. Clamp arm 205 is preferably formed of a strong resilient plastic and is preferably provided with a resilient member 206. In the preferred embodiment, clamp arm 205 is mounted on a hinge 207 and may be pivoted to bring resilient member 206 into contact with ring support member 203. When ring 1 is placed around ring support member 203, resilient member 206 will hold ring 1 firmly adjacent to ring support member 203. Clamp arm 205 may be provided with a latch or a user may hold clamp arm 205 to keep clamp 200 closed.

A first notch 208A is preferably provided in ring support member 203, and a second notch 208B is preferably provided in resilient member 206. Notches 208A and 208B will be positioned around ring 1 when ring 1 is held in clamp 200, providing a space for milling device 6 to sever ring 1, as discussed below.

A pair of mounting posts 209 also extend substantially perpendicular to face 202 of base plate 201. Mounting posts 209 are used to secure cover 210 to base plate 201. Cover 210 is preferably formed of a clear plastic such as acrylic. Cover 210 should be provided with a plurality of mounting apertures 211. Mounting apertures 211 are preferably sized and positioned to align with mounting posts 209 so that cover 210 may realign mounting apertures 211 with mounting posts 209 each time cover 210 is rotated approximately ninety degrees, resulting in four positions A, B, C, and D for cover 210.

A plurality of guide rings 212 are also provide in cover 210. Guide rings 212 will preferably all have the same circumference. However, guide rings 212 will be positioned at very slightly different locations on cover 210 relative to the center of cover 210 in each of positions A, B, C, and D. Each guide ring 212 is positioned to align roughly with notches 208A and 208B when clamp 1 is closed. However, each guide ring 212 will be positioned in cover 210 so that the center of each ring 212 is slightly further away from the center of ring support member 203 in each successive position A, B, C, and D. The object is to be able to position the center of one of the guide rings 212 at or very near the mid-point of the portion of ring 1 contained between notches 208A and 208B. The thicker ring 1, the further this mid-point will be from ring support member 203. Thus, each guide ring 212 is intended for use with rings 1 of slightly different thicknesses. Which position A, B, C, or D of cover 210 is appropriate for any ring 1 can be determined by moving cover 210 from position to position with ring 1 in place until the position is found where the portion of ring 1 in notches 208A and 208B is most closely centered in one of guide rings 212.

When the appropriate position A, B, C, or D of cover 212 is selected, a bushing 213 is preferably placed in the guide ring 212 positioned over notches 208A and 208B. Bushing 213 is simply a metal column sized to fit in guide ring 212 and having an aperture 214 running through its center. When bushing 213 is in place, a user may pass the cutting end of milling device 6 through bushing 213 and be confident that the end mill will be positioned at the center of guide ring 212 and thus, that the end mill will be cutting at the mid-point of ring 1, as discussed below. Different size bushings 213 could be used for each end mill; however, the preferred end mill sizes are close enough to each other that a single bushing 213 of sufficient inside diameter to pass all of the anticipated end mills is expected to be adequate.

Those of skill in the art will appreciate that bushing 213 could be omitted if the circumference of guide rings 212 were reduced to match the inside diameter of bushing 213. However, bushing 213 also serves to protect guide rings 212 from damage that could arise if guide rings 212 should come into contact with milling device 6.

As noted above, different end mill sizes will be used with rings 1 of different thicknesses. As also noted above, each position A, B, C, and D of cover 210 corresponds to a different ring thickness. Thus, it will be appreciated that each position A, B, C, and D correspond to a different end mill size. The inventors contemplate that positions A, B, C, and D will correspond to end mill sizes of 1.5 mm, 1.75 mm, 2.0 mm and 2.25 mm. While the inventors believe that the first three of these sizes will be sufficient for most rings, the preferred embodiment of clamp 200 easily accommodates four guide rings 212. Accordingly the inventors provided an additional position D to correspond to one additional larger end mill size. Other end mill sizes could easily be accommodated in clamp 200 either be creating additional position in cover 210 or by creating one or more additional covers 210.

Milling device 6 will be used to cut ring 1. Milling device 6 will mill through a side 4 of ring 1 along a line parallel to central axis 2. In the preferred embodiment, this will be done by placing ring 1 withing clamp 100 and securing ring 1. Ring 1 will then be aligned with the cutting portion of milling device 6. Clamp 100 and slide 108 will then be moved toward and into contact with the cutting portion of milling device 6. In the preferred embodiment of clamp 100, groove 105 is aligned with the cutting portion of milling device 6 which will allow the cutting portion to sever ring 1 without impacting clamp 100.

When clamp 200 is used, ring 1 will be held between ring support member 203 and clamp arm 205. Bushing 213 will be in place in the guide ring 212 position over the portion of ring 1 in notches 208A and 208B. The cutting portion of milling device 6 may then be passed through bushing 213 and into contact with ring 1, severing ring 1 in the manner described above. Though clamp 200 could be used with an end mill mounted on a vertical press, it will be appreciated that clamp 200 will be particularly suitable for use with end mills mounted on hand tools such as a hand drill or other hand rotary tool.

Milling device 6 will preferably cut a substantially circular opening in ring 1, forming ends 7A, 7B in ring 1. As a result, ends 7A and 7B will be crescent shaped. That is, they will have a concave curvature.

Ring 1 will then be spread to the desired circumference. This is preferably done using a mandrel comprising a graduated rod which increases in width as one approaches its base. It is marked with lines corresponding to various ring size fractions. By forcing ring 1 toward the base of the rod, the space between ends 7A, 7B can be widened and the circumference of ring 1 increased. The lines on the rod allow one to tell the size to which the ring has been expanded. In the preferred embodiment, ring 1 will be expanded in increments of ½ ring size.

A plurality of bars 8 are provided. Bars 8 will preferably be formed of the same precious metal or precious metal alloy as ring 1. Bars 8 will have two ends 9A and 9B. Each end 9A, 9B will preferably be rounded or convex. The curvature of each end 9A, 9B will substantially mirror the curvature of ring ends 7A, 7B. Substantially parallel sidewalls 10A, 10B will extend between ends 9A, 9B.

One sidewall 10A will preferably be convex while the other sidewall 10B will be concave. It will be appreciated that this configuration will result in bars 8 having a curvature. In particular, bars 8 are designed to match the curvature of a size six ring, the standard ring size for women. Though bars 8 could be tailored to match the curvature of various ring sizes, this will generally not be necessary. The curvature of a circle is the inverse of its radius. A size six ring has a radius of 0.325 inches (8.255 mm). That is a curvature of 3.08 $inches^{-1}$ (0.121 $mm^{-1}$). In comparison, a size nine ring, the standard men's size, has a radius of 0.373 inches (9.4742 mm). Thus, the curvature of a size nine ring is 2.68 $inches^{-1}$ (0.106 $mm^{-1}$). From a practical standpoint, these curvatures are quite close, and any differences are well within the shaping skills of the typical jeweler.

The width 11 of bars 8 is the dimension between ends 9A, 9B. The breadth 12 of bars 8 is the dimension perpendicular to width 11 and generally parallel to ends 9A, 9B. Bars 8 are preferably die drawn though they may be formed by extrusion, casting, or any other conventional methods of forming precious metals.

The plurality of bars 8 will vary in width 11. Preferably, one bar 8 will have a width 11 that corresponds to an increase of one-half ring size. Similarly, a second bar 8 will have a width 11 corresponding to an increase of one ring size. In the preferred embodiment, the inventors will have bars 8 corresponding to increases of one-half ring size, one ring size, one and a half ring sizes, two ring sizes, two and a half ring sizes, three ring sizes, and three and a half ring sizes. However, the bars needed to increase the circumference of ring 1 by a set ring size will not all have the same width 11.

One ring size corresponds to an increase in ring circumference of 2.5 mm. However, to increase the size of ring 1, the jeweler will need to do more than simply insert a 2.5 mm wide bar into the gap in the severed ring 1. The jeweler will also need to replace the metal removed when ring 1 was severed. Thus, if ring 1 is severed using a 1.5 mm end mill and the jeweler wishes to enlarge ring 1 by one ring size, a bar of 4.0 mm in width 11 will be needed. Similarly, if another ring 1 is severed using a 2.0 mm end mill, the jeweler will need a bar 4.5 mm in width to increase this ring 1 by one ring size.

Thus, the inventors contemplate three sets of bars 8, one set for each preferred end mill size. For the 1.5 mm end mill, the width 11 of bars 8 will be 2.75 mm (½ ring size); 4.0 mm (1 ring size); 5.25 mm (1½ ring size); 6.5 mm (2½ ring sizes); 7.75 mm (2½ ring sizes); 9.0 mm (3.0 ring sizes); and 10.25 mm (3½ ring sizes). For the 1.75 mm end mill, the width 11 of bars 8 will be 3.0 mm (½ ring size); 4.25 mm (1 ring size); 5.5 mm (1½ ring size); 6.75 mm (2 ring sizes); 8.0 mm (2½ ring sizes); 9.25 mm (3.0 ring sizes); and 10.5 mm (3½ ring sizes). Finally, for the 2.0 mm end mill, the width 11 of bars 8 will be 3.25 mm (½ ring size); 4.5 mm (1 ring size); 5.75 mM (1½ ring size); 7.0 mm (2 ring sizes); 8.25 mm (2½ ring sizes); 9.5 mm (3.0 ring sizes); and 10.75 mm (3½ ring sizes).

Larger bars 8 could be provided as desired. Similarly, additional bars 8 having widths 11 corresponding to quarter ring sizes or other dimensions could be provided, if desired. Each bar 8 will preferably be two to three inches in breadth 12, though breadth 12 of bars 8 is not as material to their use in the invention. Separate sets of bars 8 may be provided for each different precious metal or common alloy.

A bar 8 will be selected from the plurality whose width 11 matches the width of the space between ring ends 7A, 7B. A cross-section 13 of this bar 8 will be removed, preferably using a standard jewelers' saw. Cross-section 13 will be cut so that its breath 12 substantially matches the width 3 of ring 1. Thus, for example, if the width 3 of ring 1 is 5.0 mm, ring 1 is severed using a 1.5 mm end mill, and ring 1 is to be expanded one and one-half ring sizes, a bar 8 having a width 11 of 5.25 mm will be selected and a cross-section 5.0 mm in breadth 12 will be cut from the selected bar 8.

Cross-section 13 will be placed into the space between ring ends 7A, 7B. It will be appreciated that cross-section 13 will substantially match the space between ring ends 7A, 7B. The width 11 of cross-section 13 will match the width of the space between ring ends 7A, 7B. The breadth 12 of cross-section 13 will match the width 3 of ring 1, and the curvature of bar ends 9A, 9B will match the curvature of ring ends 7A, 7B. Moreover, convex sidewall 10A of cross-section 13 will align with the convex side of ring 1. Similarly, concave sidewall 10B of cross-section 13 will align with the concave side of ring 1.

As noted above, in the preferred embodiment the curvature of cross-section 13 matches the curvature of a size six ring. Thus, the curvature of cross-section 13 will either match the curvature 13 of ring 1 exactly or will be so close that only minimal working on the part of the jeweler will be required. This can be contrasted with the prior method of inserting flat stock into the space in the severed ring, wherein a substantial amount of work would have been required to convert the flat stock into a curved piece of metal matching the curvature of the ring.

Because of the close fit between the space in ring 1 and cross-section 13, there will naturally be some tension between ring 1 and cross-section 13. This will help hold cross-section 13 in place as further work is performed. The jeweler could rely solely upon this tension; however, in the preferred embodiment, solder is placed on top of the joints between ends 7A and 9A and between ends 7B and 9B. Cross-section 13 is then tacked into place with a resistance welder.

When ring 1 is made of gold or silver, ring 1 and cross-section 13 are preferably treated with boric acid before they are joined together. A boric acid and alcohol solution is prepared, preferably about ten percent boric acid by weight. This solution is applied to ring 1 and cross-section 13. The alcohol is then removed, typically with a small flame which will cause the alcohol to evaporate and/or burn, leaving the boric acid behind. The boric acid will protect ring 1 and cross-section 13 from pitting during welding.

Fluxes and compounds may be added to ring 1 and cross-section 13 to prepare them for welding. In the preferred embodiment, Blue Magic flux, available from the Okai Corporation of 687 Lehigh Ave.; P.O. Box 897; Union, N.J. 07083 is added to the joints between ring 1 and cross-section 13 prior to welding when these components are gold or silver. The inventors generally do not use flux when welding platinum components.

After preparation is complete, ring 1 and cross-section 13 are joined together, preferably by brazing them together. The traditional way ofjoining pieces is with a torch. The components would be heated with a torch until solder flows into the joint. However, the inventors preferred means of joining ring 1 and cross-section 13 is via an induction welder. The preferred induction welder 300 is the MF 75-135-400 welder sold by Bone Frontier Co. of 190 W. Southern Avenue; Brighton, Colo. 80601. This welder is a 7.5 KW welder that can operate between 135 and 400 KHz. Induction welder 300 has a coil 301 which in the preferred embodiment comprises a single loop formed from ¼ inch diameter copper tubing. A ceramic clamp 302 is positioned so that the object in the mouth 303 of clamp 302 is positioned at the center of coil 301.

Most preferably, clamp 302 is positioned so that only the portion of the object in clamp 302 that is to be brazed is at the center of coil 301.

Placing an electrically conductive object within coil 301 will induce an electrical current in the object when a current passes through coil 301. Alternating the current in coil 301 will cause the current in the object to alternate as well. The resistance of the object to both the current and its alternation will cause the object to heat quickly.

Though an induction welder 300 is preferably used to heat ring 1, cross-section 13, and the solder chips, it will be appreciated that in the preferred embodiment, ring 1 and cross-section 13 are not actually welded together, in that neither ends 7A, 7B of ring 1 nor ends 9A, 9B of cross-section 13 are melted together. Rather, the solder chips are preferably melted and allowed to flow into the joints between ring 1 and cross-section 13, brazing them together as the solder cools and hardens. Because of the close fit between ring 1 and cross-section 13, substantially less solder is required in the present method than was commonly used in prior art methods. The lesser amounts of solder required will also allow the heating time required to join ends 7A, 7B of ring 1 to ends 9A, 9B of cross-section 13 to be minimized.

When ring 1 and cross-section 13 are made of platinum, the preferred induction welder 300 is preferably operated at between about sixty and eighty percent power. When ring 1 and cross-section 13 are made of gold, preferred induction welder 300 should preferably be operated between about thirty-five and forty percent power, and when ring 1 and cross-section 13 are made of silver, preferred induction welder 300 should preferably be operated at about thirty percent power. In all instances, the inventors prefer operating induction welder 300 at 400 KHz.

In operation, ring 1 and cross-section 13 will be positioned in clamp 302 so that the joints between ring 1 and cross-section 13 are either at the center of coil 301 or immediately proximate thereto. Induction welder 300 will be turned on and the operator will observe ring 1 and cross-section 13. When the solder at the joints between ring 1 and cross-section 13 have melted and merged together, induction welder 300 will be turned off. Typically, this will only take about three or four seconds.

After the induction welding heating is complete, ring 1 and cross-section 13 will be securely joined together. Induction heating offers advantages over joining ring components with a torch. In particular, heating in the induction process occurs very quickly, and the heating is localized. In torch soldering, it takes longer to heat the metals and more of the components become hot. Long exposure to high temperatures can adversely effect the metallurgical properties of some precious metal alloys. This is avoided in the induction heating process because of its comparatively short heating time and localized regions of high temperature.

After the ring 1 and cross-section 13 are securely joined together, the jeweler will remove any excess material from cross-section 13 so that the transitions between ring 1 and cross-section 13 are smooth. For example, if cross-section 13 is thicker than ring 1 in any dimension, the excess metal will be ground off, using standard devices such as sandpaper, a file, or an MX finishing wheel. Any precious metal removed will preferably be collected for reuse.

Next, the jeweler will polish ring 1 and cross-section 13 so that ring 1 and cross-section 13 are substantially identical in finish and luster. Standard jeweler polishing methods, such as buffing ring 1 and cross-section 13 with jeweler's rouge, are contemplated. The end result will be a ring 1 that is enlarged by the desired amount and which is substantially identical to the original ring in appearance. The enlarged ring can be obtained much more quickly and efficiently under the method of the present invention than in any method previously known in the art. Because of the close fit between ring 1 and cross-section 13 that can be obtained in the present method, the pitting that would commonly occur in rings enlarged using prior art methods can be avoided or minimized.

Although the invention has been described in terms of its preferred embodiment, other embodiments will be apparent to those of skill in the art from a review of the foregoing. Those embodiments as well as the preferred embodiments are intended to be encompassed by the scope and spirit of the following claims.

We claim:

1. A method of increasing the size of a ring having a width comprising:

a) forming a plurality of bars, each bar having ends and a pair of sidewalls extending therebetween, wherein said ends have a curvature, and wherein each of said bars have a width defined as that dimension between said ends;

b) severing said ring to create two ends of said ring and a space between said ring ends, each said ring end having a curvature, wherein the curvature of said ring ends substantially mirrors the curvature of said bar ends;

c) expanding said space between said ring ends until said space is substantially as wide as the width of one of said plurality of bars;

d) cutting a cross-section from one of said plurality of bars, said one bar having a width substantially the same as the width of said space, wherein said cross section has a breadth determined by the position of said cut, wherein said breadth of said cross-section is substantially the same as said width of said ring, and wherein said curved ends of said one bar form curved ends of said cross-section; and e) inserting said cross-section of said bar into said space in said ring such that said curved ends of said cross-section are oriented toward corresponding ends of said ring, and attaching said cross-section to said ring.

2. A method of increasing the size of a ring having a width according to claim 1 wherein said sidewalls further comprise a convex sidewall and a concave sidewall opposite said convex sidewall.

3. A method of increasing the size of a ring having a width according to claim 1 wherein said plurality of bars have widths selected from the group consisting of 2.75 mm, 3.0 mm, 3.25 mm, 4.0 mm, 4.25 mm, 4.5 mm, 5.25 mm, 5.5 mm, 5.75 mm, 6.5 mm, 6.75 mm, 7.0 mm, 7.75 mm, 8.0 mm, 8.25 mm, 9.0 mm, 9.25 mm, 9.5 mm, and 10.25 mm, 10.5 mm, and 10.75 mm.

4. A method of increasing the size of a ring having a width according to claim 1 wherein said cross-section is attached to said ring via induction welding.

5. A method of increasing the size of a ring having a width according to claim 1 further comprising shaping said attached cross-section and said ring until said attached cross-section forms a substantially smooth connection between said ring ends.

6. A method of increasing the size of a ring having a width according to claim 1 further comprising polishing said attached cross-section and said ring until said ring and said attached cross-section have a substantially similar luster.

7. A method of increasing the size of a ring having a width according to claim 1 wherein said bars are comprised of precious metal.

8. A method of increasing the size of a ring having a width according to claim 7 wherein said precious metal is selected from the group consisting of gold, silver, platinum, and alloys thereof.

9. A method of increasing the size of a ring having a width according to claim 1 wherein said ring is comprised of precious metal.

10. A method of increasing the size of a ring having a width according to claim 9 wherein said precious metal is selected from the group consisting of gold, silver, platinum, and alloys thereof.

11. A method of increasing the size of a ring having a width according to claim 1 wherein said ring is severed using a milling device.

12. A method of increasing the size of a ring having a width according to claim 11 wherein said ring has sides, a center, and a central axis that passes through said center and is substantially parallel to said sides, wherein said ring is severed by milling through one of said sides along a line substantially parallel to said central axis.

13. A method of increasing the size of a ring having a width according to claim 11 wherein said ring is severed using a milling device comprising an end mill mounted on a rotatable shaft and a clamp, wherein said clamp is mounted on a moveable slide, wherein said clamp is further configured to secure said ring, and wherein said moveable slide is configured to move said ring into contact with said end mill when said slide is operated.

14. A method of increasing the size of a ring having a width according to claim 13 wherein said clamp further comprises a front plate and a back plate mounted in a frame, and a support member extending from said front plate toward said end mill.

15. A method of increasing the size of a ring having a width according to claim 14 wherein said front plate is configured to be moved vertically relative to said end mill.

16. A method of increasing the size of a ring having a width according to claim 11 wherein said ring is severed using a milling device comprising an end mill mounted on a rotatable shaft and a clamp, wherein said clamp comprises a base plate having a ring support member extending substantially perpendicular from said base plate, a clamp arm configured to secure said ring adjacent to said ring support member, and a cover having a plurality of positions, said cover further having a plurality of apertures each having a center wherein the method further comprises substantially aligning one of said centers of said apertures with a mid-point of a portion of said ring positioned between said clamp arm and said ring support member.

17. A method of increasing the size of a ring having a width according to claim 16 wherein said end mill is passed through said aperture positioned over said mid-point of said portion of said ring positioned between said clamp arm and said ring support member.

* * * * *